United States Patent [19]

Bowles

[11] 4,213,588

[45] Jul. 22, 1980

[54] FLUIDICALLY OPERATED RAILWAY SWITCH MACHINE

[75] Inventor: Colin M. Bowles, Wootten Bassett, England

[73] Assignee: Westinghouse Brake and Signal Co. Ltd., Wiltshire, England

[21] Appl. No.: 874,298

[22] Filed: Feb. 1, 1978

[30] Foreign Application Priority Data

Feb. 3, 1977 [GB] United Kingdom ..... 4375/77
Jul. 15, 1977 [GB] United Kingdom ..... 29769/77

[51] Int. Cl.[2] ..... B61L 11/06

[52] U.S. Cl. ..... 246/259; 246/258; 246/284; 246/448

[58] Field of Search ..... 246/93, 100, 139–142, 246/158, 271, 282, 284, 290, 318, 326, 380, 257–259, 278, 280, 324, 358, 396, 401, 435 R, 448

[56] References Cited

U.S. PATENT DOCUMENTS

| | | | |
|---|---|---|---|
| 1,708,245 | 4/1929 | Van Buskirk | 246/259 |
| 1,789,108 | 1/1931 | Meadows | 246/258 |
| 2,098,831 | 11/1937 | McGowan | 246/284 X |
| 2,812,426 | 11/1957 | Brown | 246/448 X |
| 3,015,464 | 1/1962 | Bush | 246/284 X |
| 3,158,345 | 11/1964 | Wilhelm et al. | 246/258 |

FOREIGN PATENT DOCUMENTS

| | | | |
|---|---|---|---|
| 1488861 | 10/1977 | United Kingdom | 246/258 |

*Primary Examiner*—Trygve M. Blix
*Assistant Examiner*—Reinhard J. Eisenzopf
*Attorney, Agent, or Firm*—J. B. Sotak; R. W. McIntire, Jr.

[57] ABSTRACT

A railway switch machine including a first fluid operated actuator for switching the movable points of the rails between two extreme positions for establishing respective routes of travel for railway vehicles, valve device coupled to the first fluid operated actuator to selectively open or to close a passageway coupled to opposite sides of a pressure differential responsive movable member of the first fluid operated actuator whereby when the valve device closes passageways wherein a fluid pressure differential may be established across the movable member to operate said first fluid operated actuator to thereby switch the movable points of the rails and when the first valve device opens the passageway, fluid may be directly exchanged between either side of the movable member such as to permit the movable points of the rails to be moved from one extreme position to the other extreme position by the passage of a railway vehicle trailing the movable points of the rails, a locking device and a second fluid operated actuator for locking the movable points of the rails in either of the two extreme positions, and a resiliently-loaded latching device for releasably latching the movable points of the rails in either of the two extreme positions.

16 Claims, 3 Drawing Figures

FLUIDICALLY OPERATED RAILWAY SWITCH MACHINE

FIELD OF THE INVENTION

This invention relates to railway switch machines and more particularly to fluidically operated trailable switch machines which remain undamaged during a trailing action by passing railway vehicles.

BACKGROUND OF THE INVENTION

In United Kingdom Pat. No. 1,488,861, there is described and illustrated a hydraulically or pneumatically operated railway switch machine in which there are separate fluid actuators for switching the movable parts or points of the rails and for locking the movable parts or points of the rails in their respective switched positions. In the past, the movable parts or points of the rails were locked except when switching operation was taking place, so that the switch points could not be trailed without damaging the switch machine and/or the mechanical linkage which connected the switch machine to the movable points of the rails. That is to say, a railway vehicle approaching the switch points on a given route in a converging direction relative to the alternative route settable by the switch machine cannot pass through the points when they are switched to the alternative route without forcing the points to switch to the vehicle's route with consequential damage to the machine or the linkage due to the points being locked to provide passage on the alternative route. It will be appreciated that switch machines which are trailable, at least at low speed are known; but it is also well recognized that damage is caused to switch machines that are not designed for trailing operation. However, the present invention provides a solution to this problem by adapting an untrailable switch machine to a trailable one which can be trailed without any resultant damage.

SUMMARY OF THE INVENTION

According to the present invention, there is provided a railway switch machine having a first fluidically, namely, either hydraulically or pneumatically, operated actuator for switching the movable parts or points of the rails between their two extreme positions for establishing the respective routes. A first valve means is coupled to the first actuator to selectively open or close a passage or conduit coupling opposite sides of a piston, vane, diaphragm, or like pressure differential responsive movable member of the first actuator. Thus, when the first valve means closes the passage or conduit, a hydraulic or pneumatic fluid pressure differential may be established across the movable member to operate said first actuator and thereby switch the movable parts or points of the rails to one of the two extreme positions. Now when the first valve means opens the passage or conduit, the hydraulic or pneumatic fluid may be exchanged between either side of said movable member such as to permit the movable parts or points of the rails to be moved from the one said extreme position to the other said extreme position by the passage of a railway vehicle trailing the points.

It will be appreciated that the first actuator may be a linear mechanism which is directly coupled to the movable points of the rails, or that the first actuator may be a nonlinear mechanism, for example, a rotary motor, which may be coupled to movable parts or points of the rails through a force and motion translating linkage, gearing, or transmission.

Further, it is understood that the valve means may be integral with or formed by combining a bypass and directional valve means having a movable valve member so constructed or adapted so as to provide an open fluid passage between either side of the pressure differential responsive movable member whereby to permit said exchange of fluid between either side of the pressure differential responsive movable member when the movable valve member is in a first position as well as to provide no direct fluid connection between either side of the pressure differential responsive movable member whereby to prevent direct exchange of fluid between either side of the pressure differential responsive movable member when the movable valve member is in another position and also to provide respective connections of either side of the pressure differential responsive movable member to a fluid pressure source or sources which in use provide mutually different fluid pressures for operation of said first actuator. The different sources may include a supply of fluid pressure which is relatively high in operation and include a fluid exhaust or drain pipe which represents a relatively low back-pressure or preferably a substantially zero back-pressure. The movable valve member may be movable to a second and third position which are distinct from said first position thereof. The movable valve member being so constructed or adapted as to connect and direct in operation the high pressure from the fluid supply to one side or to the other side of the movable member of the actuator according to whether the movable valve member is in the second position or is in the third position. The movable valve member simultaneously connects the respective other side of the movable member of the actuator in each case to the fluid exhaust or drain pipe whereby the actuator tends to operate and to switch the movable points of the rails to one extreme position or to the other extreme position. The movable valve member may take the form of a reciprocable type of spool valve having fluid passages therein and/or thereon effecting appropriate ones of the aforesaid fluid connections according to the position of the spool. In the first position of the movable valve member, one of the fluid passages provides the open fluid passage between either side of said pressure differential responsive movable member of the actuator while the movement of the movable valve member away from said first position and the movement to either the second or the third position causes the aforesaid selective removal of the passage or conduit coupling opposite sides of the pressure differential responsive movable member. The spool valve is designed and arranged to have its first position intermediate or between the second and third positions so that the movable valve member is caused to move in opposite directions from the intermediate first position.

According to United Kingdom Ministry of Transport regulations, it is desirable, but not necessary, that the movable parts of the rails of a set of points be locked for facing movements of goods, freight, and mineral trains. In accordance with these regulations, at locations which are only ever passed over by railway vehicles of any description in a trailing direction, and/or by non-passenger trains in a facing direction, the movable parts or switch points of the rails need not be locked. However, if it is desired or necessary that the movable points of the rails must be locked in one or other of their extreme positions, e.g. for facing movements of passenger trains, the switch machine of the present invention may be provided with a locking means and a second hydraulically or pneumatically operated actuator for moving the locking means between a first position in which the movable parts or points of the rails are locked in one or other of said extreme positions. The locking means may assume a second position in which the movable parts or points of the rails are freed for movement by the first actuator or by a railway vehicle trailing the points. There is provided selection means whereby the movable parts or points of the rails may be either locked or left unlocked. The selection means preferably comprises a second valve means which is coupled to control the supply of pressurized fluid to the second actuator to effect movement of the locking means between the first and second positions. The second valve means is preferably constructed or adapted to require positive actuation or operation (as distinct from automatic spring operation which is an alternate possibility) to cause the second actuator to move the locking means from the second position to the first position. Further, in the absence of said positive actuation or operation, the continued supply of pressurized fluid to the second actuator via the second valve means will maintain the locking means in the second position. Also, the locking means will remain in the second position when the fluid pressure ceases to be supplied.

If the movable points of the rails are left unlocked and the first valve means opens the passage or conduit which then due to the inherent springiness of the movable points of the rails and/or vibration caused by passage of railway vehicles on adjacent tracks, or because of some other causes, the movable parts or points of the rails may tend to take up a position intermediate the extreme positions which would cause derailment of a railway vehicle travelling through the points in a facing direction that is, towards diverging routes. Therefore, it is desirable to provide a resiliently loaded latch means mounted on or coupled to the first actuator or to the movable parts of the rails such as to latch the movable parts or points of the rails in one or other of said extreme positions against the disturbing influence of the aforesaid springiness, vibration, or other causes. The resilient loading of the latch means is arranged such that the latching effect thereof may be overcome by the forces exerted on the movable rail points by a railway vehicle trailing the points to allow the movable points of the rails to move to the extreme position appropriate to the route being taken by a trailing vehicle.

The pressurized hydraulic or pneumatic fluid supply for operating the first and second actuators may be supplied from a source which is external to the switch machine. For example, a separate compressed air pipeline may be provided, or alternatively or additionally, the pressurized fluid may be supplied by a pump which may be located adjacent to the switch machine. The pump preferably is driven by an electric motor. There is also provided a manually operable pump which may be situated in or located adjacent the machine to supply pressurized fluid to the actuators in the event of failure of the normal pressurized supply.

The first and second valve means may be separately or simultaneously actuated by one or more respective electromagnetic solenoids. In practice, the first and second valve means are constructed or adapted to be manually operated in addition to being power actuated so that the switch machine may be hand operated in the event of a power failure. Alternatively, the first valve means, when its sole function is to open and close the passage between either side of the pressure differential responsive movable means, may be spring biased to a condition in which it opens the passage or conduit, and is constructed or adapted to be moved to a condition in which it closes the passage or conduit by the build-up of fluid pressure intended for movement of said first actuator. The construction or adaptation may comprise a fluid pressure motor or actuator coupled to receive the fluid pressure and to move a movable valve member of the first valve means, in response to said build-up of fluid pressure, to the condition in which the passage or conduit is closed.

DESCRIPTION OF THE DRAWINGS

In order that the invention may be more clearly understood and readily put into effect, the preferred embodiments of the same will now be described by way of examples, with reference to the accompanying drawings wherein.

DETAILED DESCRIPTION OF THE INVENTION

Figure 1:
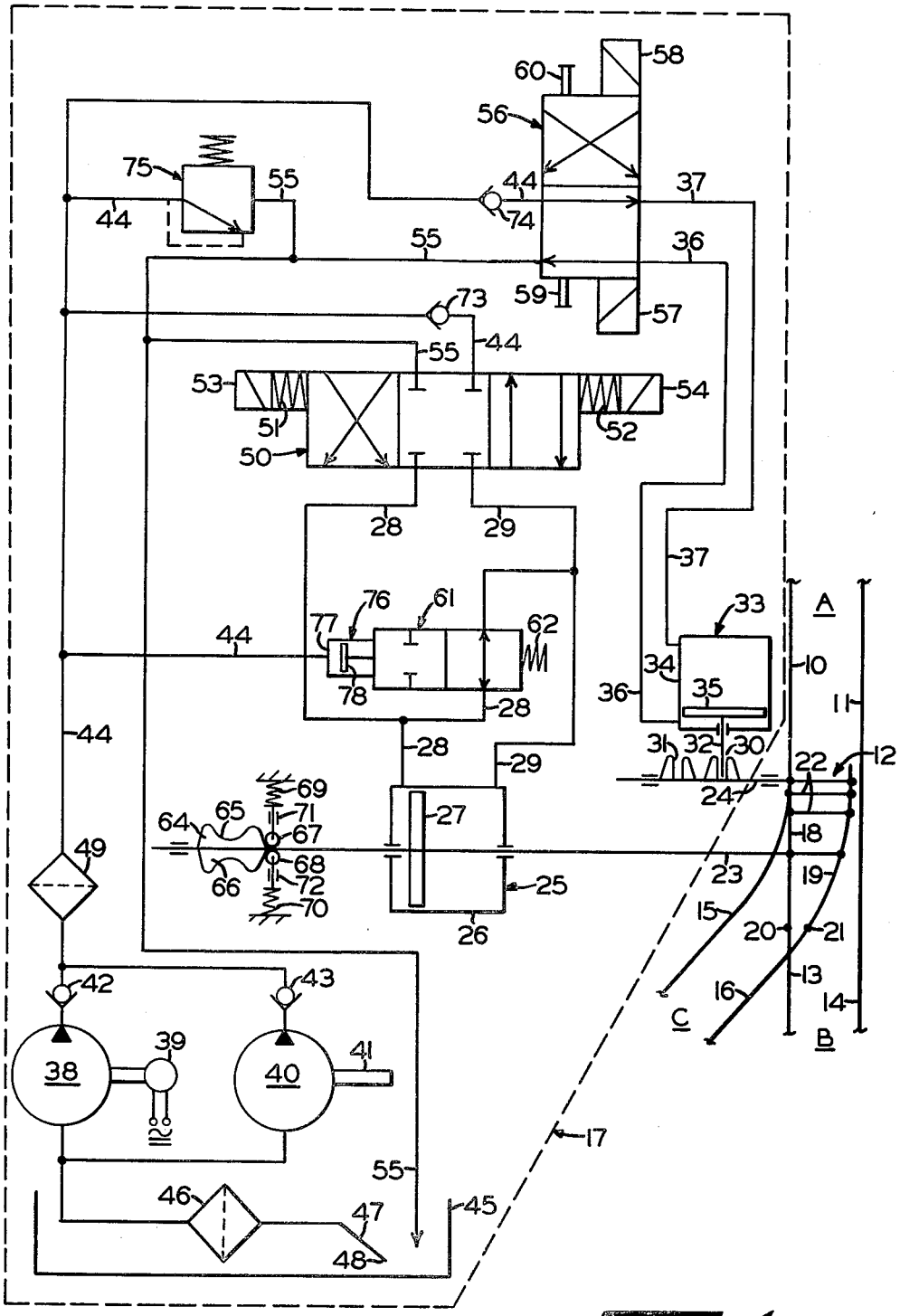
FIGS. 1, 2, and 3 are schematic circuit diagrams of the first, second and third embodiments, respectively, showing the hydraulic or pneumatic circuits thereof and the associated mechanical parts and components of the railway switch machines of the present invention, and having like elements represented by like reference numbers.

Referring now to the drawings and in particular to FIG. 1, which is purely a schematic circuit diagram showing the movements of various movable parts thereof to different scales for the purpose of convenience. As shown, a pair of track or running rails 10 and 11 is connected to a single switch 12, which can selectively change the wheels of an oncoming railway vehicle (not shown) either onto a further pair of straight track rails 13 and 14 or onto a pair of diverging track rails 15 and 16. If a vehicle is travelling in the direction from A to B or from A to C, then the oncoming vehicle is said to be passing through the switch in a "facing" direction. Conversely, if a vehicle travelling in the opposite direction, i. e. from B to A or from C to A, then the vehicle is said to travel in a "converging" direction. As shown in FIG. 1 of the drawing, the switch points 12 are switched and may also be locked, as will subsequently be described, in a direction which permits converging vehicle passage from B to A, whereas a vehicle passage from C to A requires the switch points to be trailed, i.e. forced from one extreme position to the other extreme by the passing wheels of a railway vehicle. When the single switch 12 is locked, such trailing action would generally cause mechanical damage to the switch points as well as to a switch machine 17 which will be described presently and/or to a mechanical linkage between the points and the machine. Therefore, to permit trailing action without incurring any physical damage, the switch machine 17 of the present invention is provided with certain unique features which will subsequently be described in detail.

The single switch 12, in addition to joining the track rails 10 to 15 and 11 to 14, comprises two movable rail parts or points 18 and 19. The part or point 18 joins the main rail 10 to the straight rail 13 in the position shown, and the part or point 19 joins the main rail 11 to the curved rail 16 in the opposite extreme switched position of the switch 12. The parts or points 18 and 19 are pivoted at points 20 and 21, respectively, to permit the switching movement. As shown, the movable rail parts or points 18 and 19 are coupled together for conjoint movement by a pair of tie bars 22. A throw bar 23 is coupled to the switch part or points 18 and 19 to impart switching movement thereto. A lock bar 24 is also coupled to the points 18 and 19 to move therewith and to enable the points 18 and 19 to be locked in either of their extreme switched positions as will be subsequently described. The single switch 12 as described above is a conventional type of railway switching arrangement which functions in a well known manner. The present invention resides in the unique features of the switch actuating machine 17 which selectively permits the single switch 12 to be trained by a traversing railway vehicle.

In view of FIG. 1, it will be noted that the switch machine 17 includes an actuator 25 which is coupled to the operating throw bar 23 for imparting sliding axial bi-directional movement thereto such as to shift the switch 12 between its two extreme positions. The actuator 25 may take any suitable form, for example, such as that illustrated, which comprises a cylinder 26 having sealingly slidable therein a double-acting piston 27 which is connected to the throw bar 23. In order to move the slidable piston 27 to either end of the cylinder 26, a source of pressurized fluid which may be either compressed air or pressurized hydraulic oil is selectively supplied to the appropriate side of the piston 27 via fluid conduits or pipes 28 and 29. However, before the actuator 25 can switch the movable points 18 and 19, the switch 12 must be unlocked, as will now be described.

It will be seen that the lock bar 24 has a pair or two lock slots 30 and 31 attached or formed integral along the length of the bar 24. In order to lock the switch 12, a locking means in the form of a locking member or slide rod 32 is slidable into and out of engagement with one or other of the two slots 30 and 31. The locking member 32 is positively constrained against sideways movement in order to preclude any displacement of the lock bar 24 when the locking member 32 was inserted into one of the slots 30 and 31. When the locking member 32 is inserted into the slot 30, the switch 12 is set and locked for movement on the route A to B or B to A, and when the locking member 32 is inserted into the slot 31, the switch 12 is set and locked for movement on the route A to C or C to A. When the locking member 32 is withdrawn from both of the slots 30 and 31, the switch 12 is unlocked and is free to be switched and moved by the actuator 25 or by a railway vehicle trailing the switch points 18 and 19.

As shown, the locking member 32 is coupled to a fluidic actuator 33 for suitable sliding movement thereto. The fluidic actuator 33 can take any suitable form, for example, such as, that illustrated, which comprises a cylinder member 34 having sealingly slidable therein a double-acting piston 35 which is mechanically connected to the locking member 32. In order to move the piston 35 to either end of the cylinder 34 so as to insert or withdraw the locking member 32 into or from the slot 30 or the slot 31, a source of pressurized fluid, which may be compressed air or pressurized hydraulic oil, is applied to the appropriate side of the piston 35 via fluid conduits or pipes 36 and 37.

The fluidic actuators 25 and 33 need not be of piston and cylinder type of devices but could be of any other known form of pneumatic or hydraulic motor, such as, for example, those including a vane or diaphragm, as the pressure responsive movable member. The actuators 25 and 33 need not be directly connected to the throw bar 23 and the locking member 32, respectively, but could be coupled by motion and force translating linkages or gearing or mechanisms (not shown).

In order to provide the pressurized fluid to operate the actuators 25 and 33, the switch machine 17 includes a pump 38 driven by an electric motor 39 which may be connected to an external source of alternating current voltage (not shown). The motor 39 may be transformer-coupled to an a.c. supply from a signal box (not shown), or may be connected to a battery (not shown) whose output is controlled by electromagnetic relays (not shown) which may be actuated by suitable signals from the signal box. There are several alternatives to the motor and pump, such as, compressed air or other compressed gas may be delivered from an external compressed gas pipeline (not shown), or a cylinder or reservoir of pressurized fluid replenished at suitable intervals. The latter alternatives obviate the need for electrical power which is distinct from control signals to be supplied to the switch machine 17 every time the switch 12 is to be operated by the actuator 25.

A provision is made in the event that the pump 38 and/or its drive motor 39 and/or the alternating current supply source and battery therefore should fail, or if pressurized fluid supply is not available from alternative source. It is highly advantageous to provide an auxiliary manually operable pump 40 which may be driven by reciprocating or rotary movement of a handle 41. The manual pump is pneumatically or hydraulically coupled in parallel with the pump 38 as an emergency source of pneumatic or hydraulic power for the actuators 25 and 33. A one-way flow check valve 42 is connected in the output of the pump 38 to prevent application of back pressure to the pump 40 and also to prevent reverse flow of fluid through the pump 40 when the pump 38 is being operated. Conversely, a one-way flow check valve 43 is connected in the output of the pump 40 to prevent application of back pressure to the pump 38 and also to prevent reverse flow of fluid through the pump 38 when the pump 40 is being operated. Alternatively, a suitable changeover valve (not shown) may be inserted between the pump 38 and 40 and a pressurized fluid supply distribution conduit 44. It will be appreciated that the valve 42 may be omitted if the manual pump assembly 40 is not provided and used as an emergency supply.

Let us assume the pumps 38 and 40 are hydraulic pumps and are supplied with hydraulic oil or other suitable working liquid which is to be drawn from a reservoir tank 45 via a suction filter 46. In order to prevent solid particles from being sucked-up and damaging the pumps 38 and 40, a suction tube 47 having its intake end 48 is disposed sufficiently above the bottom of the tank 45.

The pump 38 as well as the auxiliary pump 40 whether pneumatic or hydraulic is a preferably positive-displacement type of pump, and each pump may be either a reciprocating or rotary pump. In addition, the pump 38 may be a known form or type of radial piston hydraulic pump.

The outputs of the pumps 38 and 40 are preferably filtered by a filter 49 which is connected in the supply conduit or pipe 44. The filter 49 is preferably a fine filter which is appropriately capable of filtering out foreign particles from the working fluid having dimensions or diameters down to ten microns.

The supply of pressurized fluid to the actuator 25 and exhaustion of fluid from the unpressurized side of the piston 27 is controlled by a three-position pneumatic or hydraulic spool control valve 50. In the position shown in FIG. 1 of the drawings, the spool valve 50 is in its central position and is held in the shown position by the opposed actions of valve spool centralizing springs 51 and 52. In the central position of the spool valve 50, the conduits 28 and 29 leading to the actuator 25 are effectively blocked off. The valve 50 also includes spool-actuating solenoids 53 and 54 which respectively serve to move the valve 50 to the right and to the left dependent upon which solenoid is energized. When neither solenoid 53 or 54 is energized, the valve 50 returns to its central position under the influence of the biasing springs 51 and 52. Let us assume that the solenoid 53 is suitably energized so that it produces a force which overcomes the opposing force of the spring 52 and causes the valve spool to move to the right as viewed in FIG. 1. In this right-handed position, the conduit 28 is connected to the supply conduit 44 while the conduit 29 is connected to a fluid exhaust conduit 55 leading fluid back to the reservoir tank 45 to be drained for subsequent use. Thus, fluid pressure is applied to the left side of the piston 27, while the right side of the piston 27 is vented since the back pressure in the exhaust conduit 55 is negligible. Accordingly, this results in a right-handed force to be conveyed to the throw bar 23 thereby tending to switch the movable points 18 and 19 from the position shown in FIG. 1 of the drawings to the position in which a route from A to C or C to A is set. Such a switching operation will take place only if the locking member 32 is withdrawn from the lock slot 30.

On the other hand, if the solenoid 54 is energized while the solenoid 53 is deenergized, it being assumed that only one solenoid 53 or 54 is energized at a time as otherwise their effects would cancel out, the solenoid 54 will produce a force which overcomes the opposing force of the spring 51 and moves the valve spool to the left. In this left-handed position, the conduit 29 is connected to the supply conduit 44 while the conduit 28 is connected to the exhaust conduit 55. Thus, fluid pressure is applied to the right side of the piston 27 while the left side of the piston 27 is vented. Accordingly, this results in a left-handed force to be conveyed to the throw bar 23 thereby tending to switch the movable points 18 and 19 to the position shown in FIG. 1 of the drawings in which a route from A to B to A is set.

It will be seen that the application of fluid pressure to the actuator 33 controls the insertion and withdrawal of the locking member 32. The movement of locking member 32 is controlled by a two-position valve 56. Unlike the valve 50, the valve 56 has no springs acting on its spool, and is controlled solely by oppositely acting electromagnetic solenoids 57 and 58. In operation, whichever position the valve spool 56 is moved to under the influence of either one of the solenoids 57 and 58, it will remain in that position, even if the solenoid subsequently deenergizes. The spool of valve 56 will move only when the other solenoid is energized. Let us assume that the solenoid 57 too has been energized so that the valve spool 56 will be caused to move to its upward position as shown in FIG. 1 of the drawings. In this position, the conduit 37 is connected to the supply conduit 44 while the conduit 36 is connected to the exhaust conduit 55. Thus, fluid pressure is applied to the upper side of the piston 35 of actuator 33 while the lower side of the piston 35 is vented via conduits 36, 55 to reservoir 45. This causes the piston 35 to be forced downward and results in an insertion of the locking member 32.

Conversely, if the solenoid 58 is energized, the valve spool 56 is moved downwardly to a position in which the conduit 36 is connected to the supply conduit 44 while the conduit 37 is connected to the exahust conduit 55. This results in fluid pressure being applied to the underside of the piston 35 while the upper side of the piston 35 is vented to reservoir 45 thereby causing the locking member 32 to be fully withdrawn from either the lock slot 30 or the lock slot 31.

In the event that either or both of the solenoids 57 and 58 should fail and/or the power supply therefor should fail, there is preferably provided a pair of manual valve controls 59 and 60. Actuation of the manual control 59 causes the same effect on the valve spool 56 as the energization of the solenoid 57 while actuation of the manual control 60 causes the same effect on the valve spool 56 as the energization of the solenoid 58.

In order to enable the switch 12 to be trailed by a railway vehicle travelling from C to A when the movable points 18 and 19 are switched to the route B to A, as depicted in FIG. 1, the valve 56 is switched to its lower position by the energization of solenoid 58 or manipulation of control 60. This causes the actuator 33 to withdraw the locking member 32 from the lock slot 30 thereby freeing the lock bar 24, as described above. Since the solenoids 53 and 54 are both deenergized, the valve 50 is caused to assume its central position under the centralizing influences of the springs 51 and 52. Thus, the valve 50 causes the blocking off of conduits 28 and 29 from the supply conduit 44 and the exhaust conduit 55. In order to free the throw bar 23 from constraint by the actuator 25 due to the presence of fluid on either side of the piston 27 and the blocking off of the conduits 28 and 29 by the valve 50, there is provided a two-position bypass valve 61. It will be noted that in one position of the valve 61, namely, the left-handed position illustrated in FIG. 1 of the drawings, the conduits 28 and 29 are connected together by by-pass valve 61. It will be seen that the valve 61 is biased to this lefthanded position by a spring 62. When the conduits 28 and 29 are connected together as shown, the captured fluid may pass freely from one side of the piston 27 to the other side. Thus, a vehicle travelling along the rails 15 and 16 in the direction from C to A when it encounters the switch 12 will be able to act on the movable rail parts or points 18 and 19 to cause them to be switched. Since the lock bar 24 is unlocked, the throw bar 23 is subject only to the force necessary to drive fluid from the right-handed side of actuator 25. The amount of necessary driving force is relatively small in comparison to the forces exerted by the wheels of the railway vehicle acting on the movable rail parts or points 18 and 19. Therefore, with the lock bar 24 unlocked and with the throw bar 23 unconstrained by fluid pressure, the switch 12 may be readily trailed without damaging any part of the switch machine 17 or the throw bar 23 linking the movable points 18 and 19 to the actuator 25.

Now, if it is desired to operate the actuator 25 to cause switching of the movable points 18 and 19, it is necessary to close off the existing bypass between the conduits 28 and 29. This is achieved by having the bypass valve 61 switched to its other positioner right-handed position in which the conduits 28 and 29 are mutually blocked off. The switching of the valve 61 to its right-handed position is achieved by supplying pressurized fluid to the supply conduit 44 and in turn to a fluid pressure motor or actuator 76. The fluid pressure motor 76 respondes to the build-up of actuating fluid pressure in the supply conduit 44 to apply pressure to a cylinder 77 of the motor or actuator 76. The applied pressure acts upon a piston 78 which is coupled to the valve 61. Thus, it will be noted that the bypass path or circuit which is provided by the valve 61 when in its left-handed position is automatically closed off whenever the pump 38 or the pump 40 is placed into operation. Accordingly, when fluid pressure is supplied to the actuator 25 with the invention of switching the movable rail points 18 and 19 from one extreme position to the other extreme position, the fluid pressure also acts on the piston 78 to move and shift the valve 61 to its right-handed position.

When the switch 12 is free to be trailed, i.e. when the conduits 28 and 29 are connected together by the bypass valve 61, the lock bar 24 is also free due to the withdrawal or retraction of the locking member 32. Since there is no constraint from the actuator 25 or latching by the locking member 32 on the movable points 18 and 19 which could retain them in either of the extreme positions, a route through the switch 12 is readily set. Under normal conditions, the inherent springiness of the movable rail points 18 and 19, and/or vibration caused for example by the passage of railway vehicles, the movable rail points 18 and 19 might tend to take up an intermediate position between each of the two extreme positions. Thus, a dangerous route or condition would exist in that a railway vehicle approaching the switch 12 from the direction A would be derailed as it passed over the switch 12. In order to obviate and eliminate this hazard, it is advantageous to provide a mechanical latch means in the machine 17. The latch means is coupled to the movable rail points 18 and 19 and is arranged to latch the movable rail points 18 and 19 in either of their extreme positions. However, the latching means is capable of being unlatched to allow the movable rail points 18 and 19 to switch and move under the separating forces caused by a railway vehicle trailing the switch 12. The latch means 64 preferably takes the form of two cams 65 and 66 secured to an extension portion of the throw bar 23, and cooperating with the cams 65 and 66 are cam follower means in the form of two balls or rollers 67 and 68 resiliently loaded by respective springs 69 and 70. The balls or rollers 67 and 68 are guided by respective guide means 71 and 72 for movement only toward and away from the extension of the throw bar 23. Thus, the guide means 71 and 72 prevent sideways movement in the direction of movement of the throw bar 23. The balls or rollers 67 and 68 nestle against the respective ends of the cams 65 and 66 when the movable rail points 18 and 19 of the switch 12 are in either of their two extreme switched positions. The resilient loading on the balls or rolers 67 and 68 and their reaction against the cams 65 and 66 prevents movement of the throw bar 23 and hence of the movable rail points 18 and 19 even when the movable rail points 18 and 19 are subject to the spring forces and/or vibration tending to move them away from their extreme positions. The cams 65 and 66 have steeply sloping ends such that the force initially required to move the throw bar 23 is high, for example, of the order of 1000 1bf. It will be appreciated that this high force is only produced by a railway vehicle trailing the switch 12, i.e. by the effect of a wheel travelling on the rail 15 wedging against the movable rail point 18. Thus, the movable rail points 18 and 19 are latched against undesired movement yet being capable of becoming unlatched to switch to accommodate a trailing vehicle. It will be noted that the cams 65 and 66 sag or dip at their middle sections. Thus, the cams 65 and 66 are shaped to reduce the forces on the cams 65 and 66 while the throw bar 23 is traversing. As an alternative, the cams 65 and 66 may be modified to have a flat or level surface between their respective end slopes. The provision of two cams 65 and 66 together with resilient loading thereon from the balls or rollers 67 and 68 and their associated springs 69 and 70 on either side of the extension of the throw bar 23 produces oppositely directed forces on the extension which tend to cancel out and so minimize or substantially eliminates sliding friction. Therefore, if side thrust on the extension can be accommodated, then only one cam and one resiliently loaded cam follower means need be provided. The cam means and resiliently loaded follower means may be located in alternative positions in the illustrated arrangement; for example, such alternative locations might be on the throw bar 23 between the actuator 25 and the switch 12. The latch means may also be located on the lock bar 24, or on one or both of the tie bars 22.

As an alternative to the provision of cams and resiliently loaded cam follower means to latch the movable rail points 18 and 19, it is apparent that resiliently loaded valve means could be inserted in the bypass circuit which couples the conduits 28 and 29. The resiliently loaded valve means prevents the free transfer of fluid between either side of the piston 27 to take place. The transfer cannot take place until the pressure on one side of the piston 27 has built up which would result when the required thrust on the throw bar 23 is caused by a vehicle trailing the switch 12. This high level thrust would cause the resiliently loaded valve to lift and allow to open the valve to passage of fluid between opposite sides of the piston 27.

It will be noted that a one-way fluid check valve 73 is located in the supply conduit 44 leading to the valve 50 and that the similar one-way fluid check valve 74 is situated in the supply conduit 44 leading to the valve 56. The check valves 73 and 74 prevent reverse flow of fluid in the supply conduit 44 in the event of unintentional reverse movement of either of the actuators 25 and 33. Thus, when the pumps 38 and 40 are not operating, the valves 73 and 74 prevent any reverse flow from one of the actuators 25 and 33 so that inadvertent movement of the other one of the actuators 25 and 33 does not result. If for some reason, the pump 38 or the pump 40 did not cease pumping when the piston 27 or the piston 35 reached the end of its stroke, an undesirably high pressure might build up in the supply conduit 44 as well as in the valves 50 and 56 which could lead to leakage and/or pressure-induced damage, such as, for example diaphragm or gland rupture. It is therefore preferred to incorporate a known form of resiliently loaded pressure relief valve. The relief valve is connected between the supply conduit 44 and the exhaust conduit 55. Normally, the valve 75 remains closed at ordinary working pressures. However, if the pressure in the supply conduit 44 reaches a predetermined pressure, such as, for example 2000 pounds per square inch, the resilient loading of the valve 75 is overcome and the valve 75 opens to permit passage of fluid from the supply conduit 44 directly to the exhaust conduit 55.

Thus, the relief valve 55 prevents the pressure in the supply conduit 44 from reaching an excessive level.

It will be noted that the electrical connections to the electromagnetic solenoids 53, 54, 57 and 58 as well as to the limit switches and their associated electrical circuits are not shown in FIG. 1 of the drawings. In practice, they are arranged to be operated when the actuators 25 and 33 reach their limit of movement so as to actuate the valves 50 and 56 to close off the supply of pressurized fluid to the actuators and/or to cause the pump 38 to cease pumping. Also not shown in the drawings are the conventional switch means coupled to the switch 12 which provide electrical signals back to a point-controlling signal box to indicate that the switch 12 has fully switched to either extreme position. The above connections and switches have been omitted for the sake of clarity and convenience, and it is apparent that their structure and function will be obvious to those skilled in the art.

An incidental advantage of the present invention is that while the actuator 25 is required to be relatively powerful in order to switch the movable switch points 18 and 19 against their inertia and friction, the actuator 33 requires only a relatively small amount of power which is sufficient to overcome any friction retarding the movement of the locking member 32. That is, the insertion or extraction of the locking member 32 into one of the lock slots 30 and 31 requires very little power. Moreover, should either slot 30 or slot 31 become misaligned with the locking member 32 due to the movable rail point 18 and 19 not being fully switched, it is highly unlikely that damage will occur upon attempted insertion of the locking member 32. This compares favorably with prior art switch machines employing a single dual function actuator both form switch movement and switch point locking. Since these prior art actuators were necessarily powerful to switch the movable points, and moreover were so powerful as to be likely to cause damage when attempting to lock misaligned ports of the switch point locking mechanism.

For a preferred mechanical layout of the components of the present invention, as shown in the drawing and including the aforementioned limit switches, attention is directed to the drawings and related description of the above-mentioned United Kingdom Pat. No. 1,488,861. The components of the present invention are preferably arranged in like manner with suitable provision being made for the inclusion of the modified lock actuator control valve 56, the extra bypass valve 61, and the latch means 65–72. These features being the principal distinguishing features of the present invention and providing a major modification of, and improvement in relation to the prior art.

It will be appreciated that there are circumstances in which it is not necessary that the movable rail points 18 and 19 be positively locked in either or their extreme switched positions, e.g. for trailing movement only and/or passage solely of non-passenger trains. Under such circumstances, the lock bar 24, the actuator 33, and the valve 56 may be omitted so that the latch means 65–72 will serve to maintain the movable rail points 18 and 19 free to be switched by a trailing vehicle.

Figure 2:
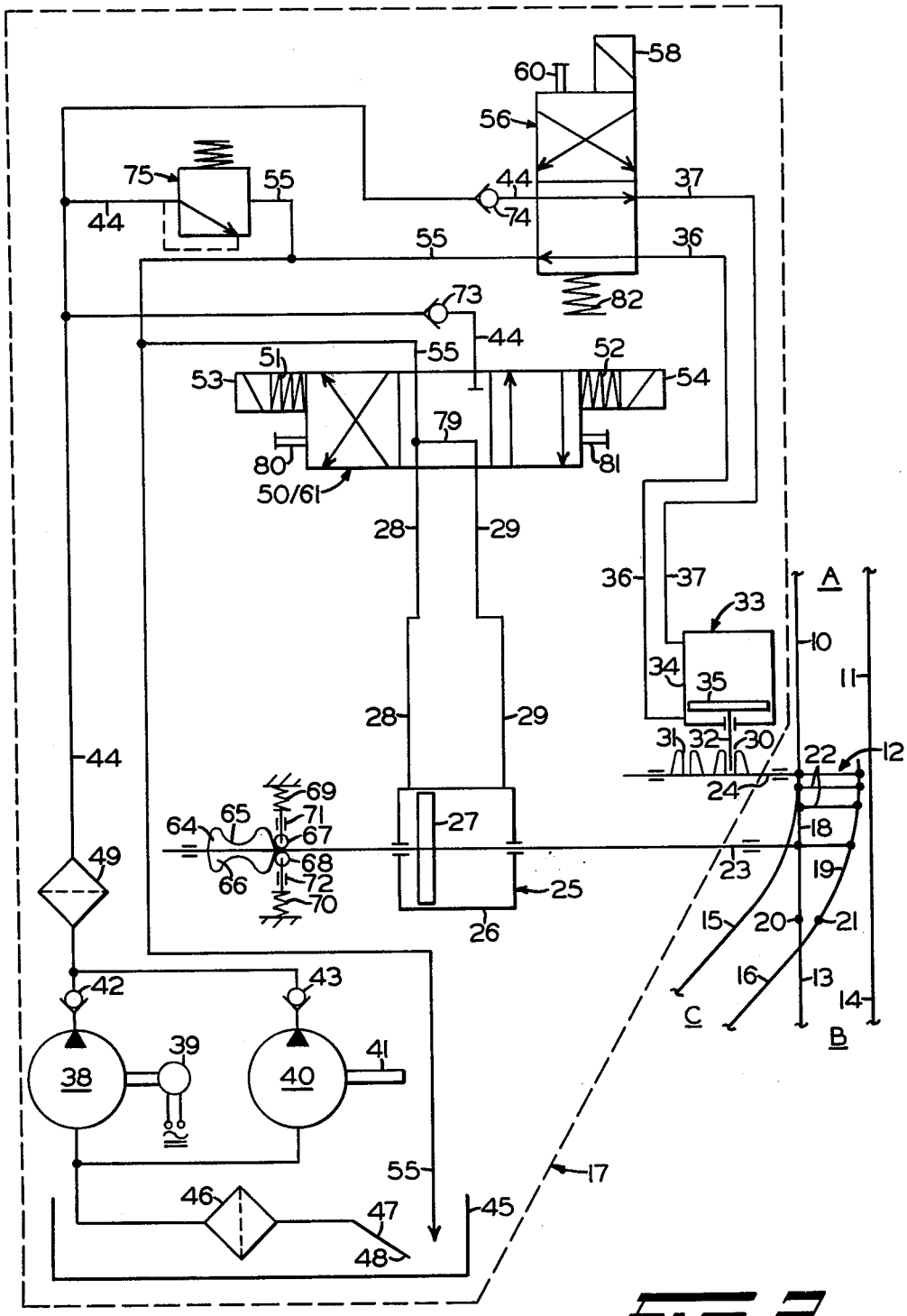

Referring now to FIG. 2, this illustrates a modification of the embodiment of FIG. 1, and the various parts in FIG. 2 that are the same as those in FIG. 1 are given the same reference numerals.

The principal difference and change between FIG. 2 and FIG. 1 is that the direction control valve 50 and the bypass valve 61 are combined into a single valve performing the dual functions of both valves 50 and 61. The combined single valve is consequently designated 50/61 which is a reference numeral intended to be different from either 50 or 61 per se. As in FIG. 1, the valve 50/61 is a three-position valve which is shown in FIG. 2 in its central or mid-position. It will be seen that the actuator supply conduits 28 and 29 are connected together by an internal passageway 79 to provide the fluid bypass for trailability, as fully described with reference to FIG. 1. The passageway 79 is also connected to the exhaust conduit 55 when the valve 50/61 is in mid-position to relieve the actuator 25 of any residual high pressure as well as to carry any relative displacement volumes during movement of the actuator piston 27 within the actuator cylinder 26. It will be noted that when the valve 50/61 is in its mid-position, the supply conduit 44 is blocked off.

When the valve 50/61 is moved either to the left-hand or to the right-hand position, the bypass passageway 79 is effectively removed from the position in which it connected the actuator conduits 28 and 29, thus removing the fluid bypass. It will be appreciated that the connection of the conduits 44 and 55 to the conduits 28 and 29, and the consequences thereof, are exactly as described for left-hand and right-hand movement of the valve 51 in FIG. 1.

A preferred feature of the valve 50/61 which is not present in the valve 51 of FIG. 1 but which could optionally be added thereto is the provision of manual valve controls 80 and 81. It will be noted that the actuation of the manual control 80 causes the valve 50/61 to move to the right which is the same as if the solenoid 53 had been energized. Similarly, the actuation of the manual control 81 moves the valve 50/61 to the left as if the solenoid 54 had been energized.

Another change in the arrangement of FIG. 2 as compared to FIG. 1 is to the lock cylinder control valve 56. It will be noted that the solenoid 57 and manual control 59 have been removed and have been replaced by a bias spring 82. Thus, the spring 82 biases the valve 56 into an upward position to cause the lock member 32 to undergo an insertion movement. The energization of the solenoid 58 or the manipulation of the manual control 60 overcomes the biasing force of the spring 82 and moves the valve 56 to a downward position in which fluid pressure in the supply conduit 44 is applied to the underside of the piston 35. Thus, the upward movement of the piston 35 causes the lock member 32 to retract or withdraw from the lock slot 30 or 31 and permit the switching of the switch 12. The solenoid 58 is continuously energized or the manual control 60 is continuously actuated if it is desired to free the lock bar 24 to allow the switch 12 to be trailed. It is assumed that for this purpose the valve 50/61 is allowed to return to its mid-position under the influence of the centering springs 51 and 52 to cause the passage 79 to connect together the conduits 28 and 29.

Figure 3:
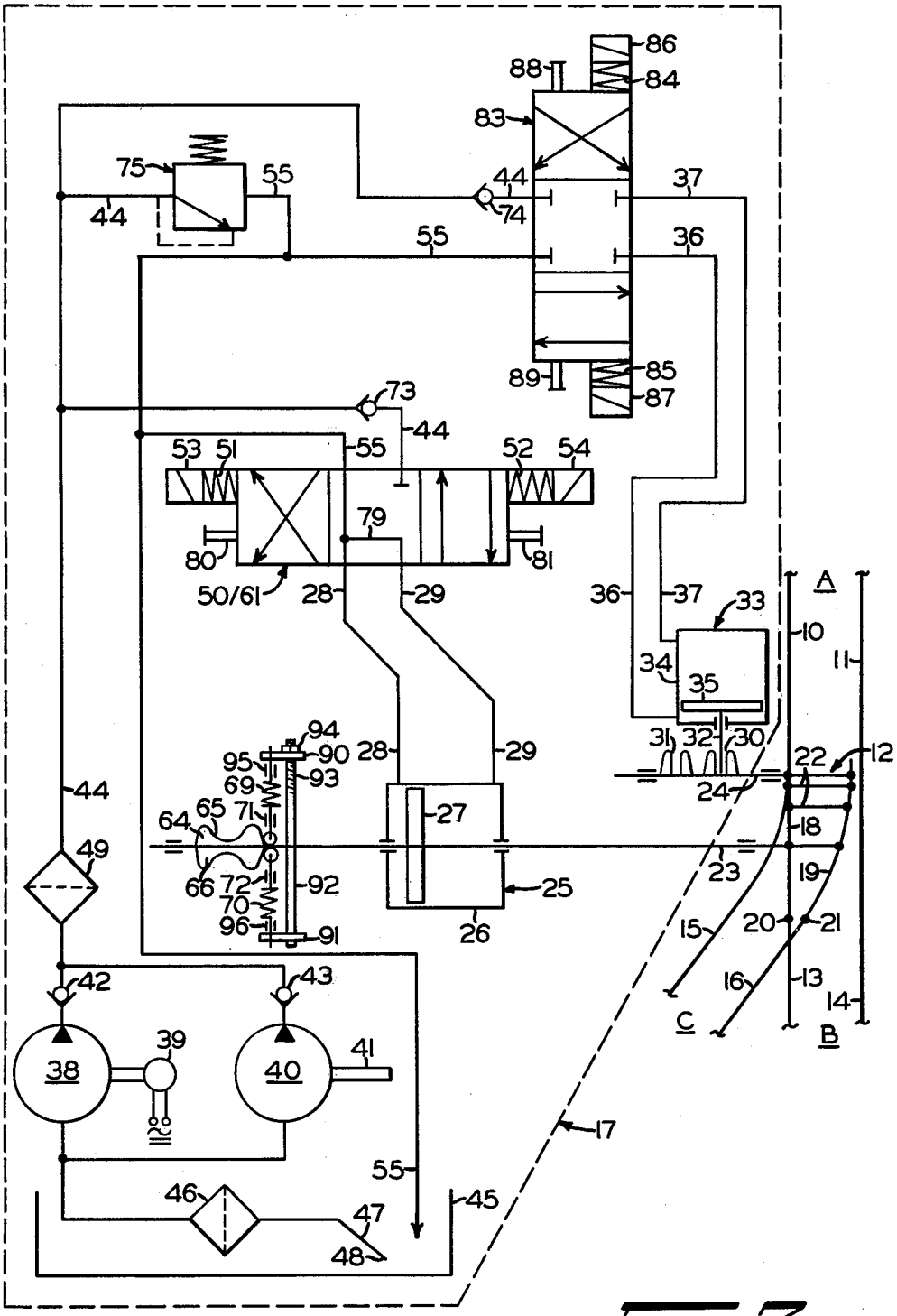

Referring now to FIG. 3, this shows an arrangement which is similar to the arrangement of FIG. 2, except that the two-position lock cylinder control valve 56 is replaced by a three-position control valve 83 and a certain mechanical change is also optionally made, as will be described hereinafter. As shown, when the valve 83 is in its mid-position, the supply conduit 44 and the exhaust conduit 55 are blocked off from the conduits 36 and 37. The valve 83 is biased to its illustrated mid-position under the influence of valve centering springs 84 and 85, in the manner of the centering action of the valve 51 in FIG. 1. When the valve 83 in its mid-position and with the blocking off of the conduits 36 and 37, the piston 35 and the lock member 32 tend to remain in their previously set position whether the lock member 32 is inserted or withdrawn.

When the valve actuating solenoid 86 is energized, the valve 83 is moved downwardly to a position in which the supply conduit 44 is connected to the conduit 36 and the exhaust conduit 55 is connected to the conduit 37. Under this condition, pressure is applied to the underside or bottom of the piston 35 which tends to withdraw the lock member 32 from either the lock slot 30 or the slot 31.

Conversely, when the valve actuating solenoid 87 is energized, the valve 83 is moved upwardly to a position in which the supply conduit 44 is connected to the conduit 37 and the exhaust conduit 55 is connected to the conduit 36. Under this condition, pressure is applied to the top or upper side of the piston 35, which tends to insert the lock member 32 into one of the lock slots 30 and 31.

In the event of failure of the solenoid 86 or the power supply thereto, a manual control 88 may be operated to move the valve 83 to its downward position which will simulate the energization of the solenoid 86.

In the event of failure of the solenoid 87 or of the power supply thereto, a manual control 89 may be operated to move the valve 83 to its upward position which will simulate the energization of the solenoid 87.

As with the valves 50 and 50/61 of FIGS. 1 and 2, respectively, only one of the solenoids 86 and 87 will be energized at a time. If both were simultaneously energized, their opposite thrusts would tend to mutually cancel and the valve 83 would tend to remain in its mid-position.

The piston 35 and the lock member 32 will tend to remain in the previously set position whether the lock member 32 is in its inserted or withdrawn position when the valve 83 is in its mid-position due to the blocking off of the conduits 36 and 37. However, the lock member 32 may be positively maintained in its inserted or withdrawn position by keeping the valve 83 continuously in its upward or downward position, respectively, and simultaneously keeping the pump 38 or the pump 40 operating. In this case, the relief valve 75 may operate continously.

The optional mechanical variation shown in FIG. 3 concerns the latching mechanism. In place of the fixed abutments against which the springs 69 and 70 act on in the FIGS. 1 and 2 embodiments, the outer ends of the springs 69 and 70 are tied together by means of a bracket 90 fixed to the outer end of the spring 69 and a bracket 91 fixed to the outer end of the spring 70. The brackets 90 and 91 being held a fixed distance apart against the outward urging of the springs 69 and 70 by a tension-transmitting rod or tie bar 92. The tie bar 92 is anchored at one end in the bracket 91 and has a screw threaded portion 93 passing through the braket 90. A lock nut 94 is screwed onto the portion 93 to clamp the bracket 90 in tension through the rod or tie bar 92 to the bracket 91. Thus, the outer ends of the springs 69 and 70 are held a fixed distance apart, and the compressive forces exerted by the springs 69 and 70 are readily adjustable by varying the distance between the outer ends thereof by means of simply turning the lock nut 94 on the screw threaded part 93 of the rod or tie bar 92. A pair of supplementary guides 95 and 96 guide the outer ends of the springs 69 and 70 and the attached brackets 90 and 91 permit only inward and outward movement of the ends of the springs 69 and 70. The advantage of this arrangement is that the force exerted by the spring 69 is transmitted through the rod or tie bar 92 to the spring 70. Since there are no fixed abutments or other static force absorbing means the forces exerted by the springs 69 and 70 must at all times be substantially equal, (as well as being readily adjustable) and thus there is substantially no side thrust on the throw bar 23. It will be appreciated that the adjustable latch mechanism may be attached to other parts and in other positions as described with reference to FIG. 1.

The modification of the latch mechanism shown in FIG. 3 could equally be applied, if desired, to the latch mechanisms shown in FIGS. 1 and 2.

It will be apparent that certain changes and variations can be made in the presently described invention, and, therefore, it is understood that all changes equivalents and modifications within the spirit and scope of this invention are herein meant to be included in the appended claims.

Having now described the invention, what I claim as new and desire to secure by Letters Patent, is:

1. A railway switch machine comprising, fluidically actuating means for switching movable points of rails between two extreme positions, valve means coupled to said fluidically operated actuating means for selectively controlling fluid flow in a pair of passageways each of which is coupled to opposite sides of a pressure differential responsive movable member of said fluidically operated actuating means whereby when said valve means connects a source of fluid pressure to said passageways between said opposite sides of said fluidically operated actuating means so that a fluid pressure differential is established across said pressure differential responsive movable member to operate said fluidically operated actuating means to thereby switch the movable points of the rails from one extreme position to the other extreme position and when said valve means interconnects said passageways between said opposite sides of said fluidically operated actuating means fluid is directly exchanged between either side of said movable member such as to permit the movable points of the rails to be moved from one extreme position to the other extreme position by the passage of a railway vehicle trailing the movable points, said valve means includes an integrally formed bypass and directional valve means having a movable valve member which is adapted to assume a first position of the movable valve member to establish a fluid passage between opposite sides of said pressure differential responsive movable member whereby to permit said exchange of fluid between opposite sides of said pressure differential responsive movable member and which is adapted to assume another position of the movable valve member to prevent direct fluid connection between opposite sides of said pressure differential responsive movable member, and resiliently-loaded latching means cooperatively associated with said fluidically operated actuating means for latching the movable points of the rails in either of the two extreme positions so that the springiness of the movable points or vibration caused by passing railway vehicle is incapable of causing the movable points of the rails to assume an intermediate position between the two extreme positions.

2. The railway switch machine as defined in claim 1, wherein said opposite sides of said pressure differential responsive movable member may be coupled to fluid pressure sources which provide mutually different fluid pressures for operation of said fluidically operated actuating means.

3. The railway switch machine as defined in claim 2, wherein said fluid pressure sources may comprise a source of fluid at a pressure which is a relatively high pressure in operation and a fluid exhaust for presenting a relatively low back pressure.

4. The railway switch machine as defined in claim 1, wherein said movable valve member may be moved to second and third positions which is distinct from said first position so as to selectively connect said source of said high pressure fluid to one side or to the other side of the movable member of the fluidically operated actuating means according to whether the movable valve member is in said second or said third position and to simultaneously connect the other respective side of the movable member of said fluidically operated actuating means to the fluid exhaust whereby said fluidically operated actuating means tends to switch the movable points of the rails to one extreme position or to the other extreme position.

5. The railway switch machine as defined in claim 1, wherein said movable valve member includes a reciprocable spool having fluid passages for effecting appropriate ones of the aforesaid fluid connections according to the position of the spool.

6. The railway switch machine as defined in claim 5, wherein said movable valve member provides said open fluid passage between either side of said pressure differential responsive movable member of said fluidically operated actuating means when in said first position and movement of said movable valve member away from said first position to said second or third position causes the aforesaid selective removal of said passage coupling the opposite sides of said pressure differential responsive movable member.

7. The railway switch machine as defined in claim 6, wherein said first position is located intermediate the second and third positions which are positions of the movable valve member in opposite directions from the intermediate first position thereof.

8. The railway switch machine as defined in claim 1, wherein said fluidically operated actuating means is a linear actuator which is directly coupled to the movable points of the rails.

9. The railway switch machine as defined in claim 1, wherein said resiliently-loaded latch means includes cam means and spring biased cam follower means for latching the movable points of the rails in one or other of said extreme positions but which is capable of being overcome by the force exerted on the movable points of the rails during a trailing action by the passage of railway vehicles to allow the movable points of the rails to move from one to the other extreme position.

10. The railway switch machine as defined in claim 1, wherein a locking means and an associated operated actuator moves the locking means between a first position in which the movable points of the rails are locked in said two extreme positions and a second position in which the movable points of the rails are freed for movement by said fluidically operated actuating means or by a railway vehicle trailing the movable points.

11. The railway switch machine as defined in claim 10, wherein control means are connected to said associated operated actuator whereby the movable points of the rails may be selectively locked or left unlocked.

12. The railway switch machine as defined in claim 11, wherein said control means comprises another valve means coupled to control the supply of pressurized fluid to said associated operated actuator to effect movement of the locking means between said first and second positions and said latter valve means is adapted to require positive actuation in a sense as to cause said associated operated actuator to move said locking means from said second position to said first position whereby in the absence of said positive actuation the continued supply of pressurized fluid to said associated operated actuator via said latter valve means will maintain the locking means in said second position so that the locking means will remain in said second position when said supply ceases.

13. The railway switch machine as defined in claim 12, wherein a fluid pressure motor receives said fluid pressure to move a movable valve member of said another valve means in response to said build-up of fluid pressure to the condition in which said passage is closed.

14. The railway switch machine as defined in claim 10, wherein pressurized fluid for operating said fluidically operated actuating means and said associated operated actuator is supplied by a pump which is driven by an electric motor, and a manually operable pump may supply pressurized fluid to said actuating means and said actuator in the event of failure of the normal supply.

15. The railway switch machine as defined in claim 10, wherein said valve means and said another valve means may be actuated by electromagnetic solenoids and are adapted for manual operation in addition to power operation whereby the switch machine may be manually operated in the event of a power failure.

16. The railway switch machine as defined in claim 15, wherein said former valve means is in a form solely for opening and closing the passage between either side of the pressure differential responsive movable means and may be spring biased to a condition in which it opens said passage and is adapted to be moved to a condition in which it closes said passage by the build up of fluid pressure intended for movement of said fluidically operated actuating means.

* * * * *